United States Patent [19]

Ortiz

[11] Patent Number: 4,550,916

[45] Date of Patent: Nov. 5, 1985

[54] CUBE GAME OF SKILL AND CHANCE

[76] Inventor: Ralph O. Ortiz, 100 Beekman St., Apt. 8-D, New York, N.Y. 10038

[21] Appl. No.: 623,141

[22] Filed: Jun. 21, 1984

[51] Int. Cl.[4] ..... A63F 3/00

[52] U.S. Cl. ..... 273/239; 273/265; 273/267

[58] Field of Search ..... 273/265, 276, 239, 267

[56] References Cited

U.S. PATENT DOCUMENTS

| | | | |
|---|---|---|---|
| 2,100,421 | 11/1937 | Wupper | 273/265 |
| 3,046,017 | 7/1962 | Kazakevich | 273/265 X |
| 3,082,004 | 3/1963 | Friedman | 273/265 X |
| 3,550,943 | 12/1970 | Hatcher | 273/265 X |
| 4,150,830 | 4/1979 | Sink | 273/265 |
| 4,280,704 | 7/1981 | Massimei | 273/265 X |

FOREIGN PATENT DOCUMENTS

| | | | |
|---|---|---|---|
| 2290231 | 6/1976 | France | 273/265 |

OTHER PUBLICATIONS

Sear Spring–Summer 1981 Catalog, p. 1409 to Bathroom Contour Rugs.

*Primary Examiner*—Harland S. Skogquist
*Attorney, Agent, or Firm*—Richard L. Miller

[57] ABSTRACT

Cube game of skill and chance in which players insert rod shaped playing piece through apertures on one face of a hollow cube. Long pieces protrude through opposing holes on the opposite playing surface and short pieces do not. Either playing pieces dislodge the opponent's playing piece if it occupies a corresponding aperture. Unique light blocking channels between opposing apertures are formed from either drooping flexible tubing or drooping collapsible woven mesh tubing. The collapsed channels block light when no playing piece is present and open to allow the insertion of the playing pieces. Playing pieces may be assigned both negative and positive scoring value. Pads are provided to protect the expelled piece and the surface upon which the game is placed.

8 Claims, 12 Drawing Figures

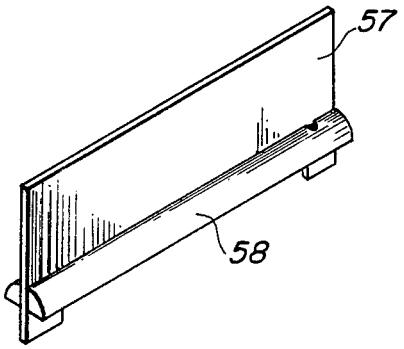
Fig.5
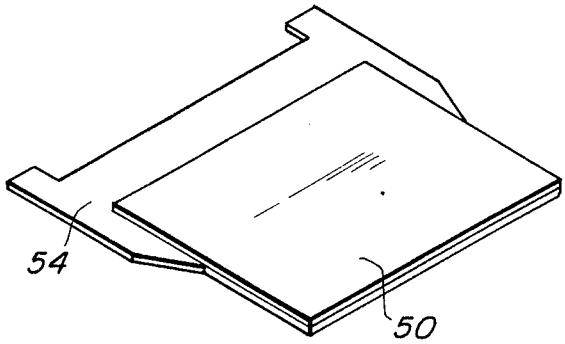
Fig.7
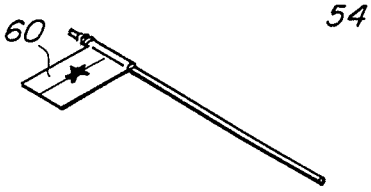
Fig.6
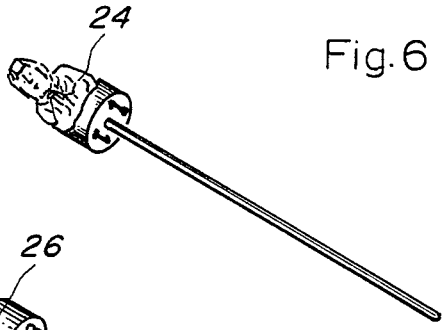
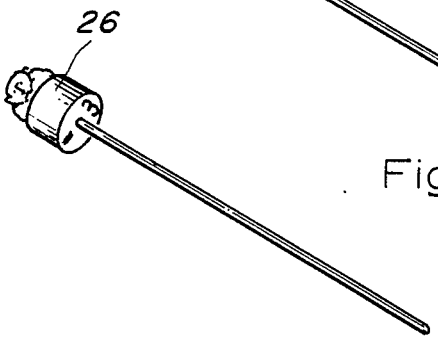
Fig. 8
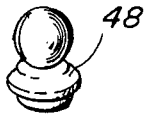
Fig.9
Fig.10
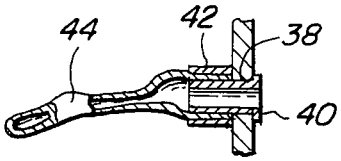
Fig. 12

CUBE GAME OF SKILL AND CHANCE

BACKGROUND OF THE INVENTION

The present invention relates generally to the field of amusement devices, and, more specifically, to the field of table games utilizing rods as playing pieces.

A number of games have been provided in which the playing pieces which are out of clear sight are used to increase the excitement of the game and to provide for intuitive guessing. J. Hatcher (U.S. Pat. No. 3,550,943) provides an apertured board and marker game apparatus in which markers are pushed through apertures between opposite playing surfaces. In this invention each of the apertures represent channels of various shapes through a solid. In order to block the passage of light through the channels and thereby prevent detection of the insertion of a marker from the opposing side, channels must be curved. Markers must also, then, be flexible. This is both difficult and expensive to fabricate. J. Weisbecker (U.S. Pat. No. 3,630,525) provides a board game apparatus in which also contains various straight channels through a solid mass and therefore also permits the transmission of light through the channel.

SUMMARY OF THE INVENTION

It is, therefore, a primary object of the present invention to provide a cube game of skill and chance in which channels are provided through which straight rods may pass but through which light is excluded.

Another object is to provide a cube game of skill and chance which is simple and inexpensive to fabricate.

Another object is to provide a cube game of skill and chance in which some rod shaped pieces protrude fully through apertures on the playing surfaces of the cube and are visible to both players.

Another object is to provide a cube game of skill and chance in which some rod shaped pieces protrude only partially through apertures on the playing surfaces of the cube and are visible only to the player who inserted the piece.

A further object is to provide a cube game of skill and chance in which the shorter pieces may be capped by various three dimensional figures for the purpose of scoring the pieces should an opponent cause one of the pieces to become dislodged by the insertion of his own piece. Pieces may be assigned positive or negative values.

A further object is to provide a cube game of skill and chance in which magnetic markers are used to signify activity involving a cluster of four apertures in a square pattern.

A yet further object is to provide a cube game of skill and chance which has an accessory partition to further impede the observation of one player's move by another player.

A yet further object is to provide a cube game of skill and chance with pads located at the base of each playing surface so that expelled playing pieces are protected from damage and the surface upon which the invention rests is similarly protected.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIGS. 4 through 10 are individual perspective views of the various components of the invention.

FIG. 12 is an enlarged cross sectional view of a portion similar to FIG. 11, showing a channel made of collapsible woven mesh tube.

DETAILED DESCRIPTION OF THE PREFERRED EMBODIMENTS

Figure 4:
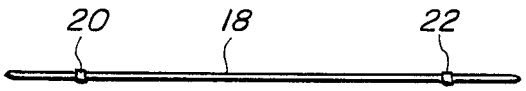

The invention 10 shown resting upon a table 12 is in the form of a hollow cube four of whose surfaces are solid and two opposing playing surfaces, one of which is typified by 14 has a grid of apertures. In the example illustrated, the grid of apertures is a ten by ten matrix of one hundred openings one of which is typified by 16. Rods of various sizes may be inserted through these apertures. One rod shaped playing piece is a simple rod 18 which is provided with end markers 20 and 22. When simple rod 18 in FIG. 4 is inserted by a player as far as the second marker, simple rod 18 will protrude equally through opposite apertures on both playing surfaces. Many shorter pieces may be designed with decorative three dimensional figures on one end such as 24 in FIG. 8 and 26 in FIG. 10 where scores of +1 and −3 respectively may be seen marked on the undersides. When these shorter pieces are inserted by a player, from one playing surface it is impossible an opponent player to visually detect them at the other playing surface. Detection is achieved through the insertion of the simple rods 18 which remain inserted during the game.

Figure 3:
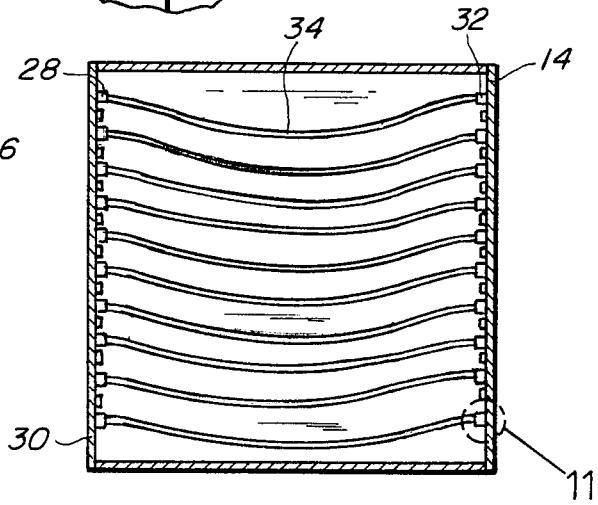
FIG. 3 is a cross sectional view taken on line 3—3 of FIG. 1.
Figure 11:
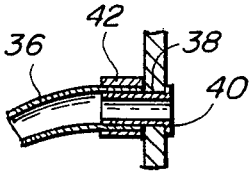
FIG. 11 is an enlarged cross sectional view of a portion of FIG. 3, as indicated by dotted circle 11, showing a channel made of flexible tubing.

This visual detection of playing pieces from opposite playing surface is prevented because of the technique for blocking the transmission of light through the channels. This may best be understood with reference to FIGS. 3, 11 and 12. For example, aperture 32 in playing surface 14 and opposite aperture 28 in playing surface 30 are connected by a drooping channel 34 through which light may not pass yet an inserted playing piece will easily pass. One way of achieving this is illustrated in FIG. 11 where drooping channel 36 which is typically made of a piece of flexible tubing is attached at aperture 38 by a rivet 40 and is secured to the rivet by a retaining ring 42. In FIG. 12, the piece of tubing is replaced by a piece of collapsible woven mesh tube 44 which collapses more completely and thus provides better light blocking qualities.

Figure 2:
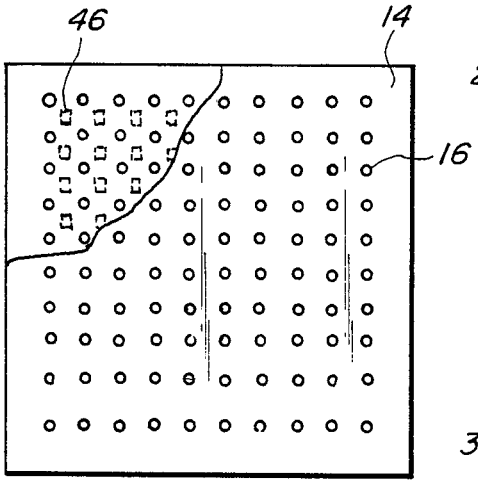
FIG. 2 is a view of one of the playing surfaces of the invention with a corner broken away to illustrate internal components therein.

The way in which markers may be provided is best understood with reference to FIGS. 2 and 9. The inside surface of playing surface 14 is equipped with small permanent magnets such as 46. Each of these magnets are centrally mounted between each square cluster of four holes. Markers such as 48 made of ferromagnetic materials adhere to the playing surface 14 wherever these permanent magnets are located.

Pads 50 and 52 are provided to protect any expelled playing pieces and to protect table 12. Pad mounts 54 and 56 are used to position pads 50 and 54 respectively. A partition 57 with partition stop 58 further reduce the ability of the players to visibly discern each others' moves. Flags 60 and 62 may be placed into apertures in partition stop 58 and may be used as playing pieces.

Figure 1:
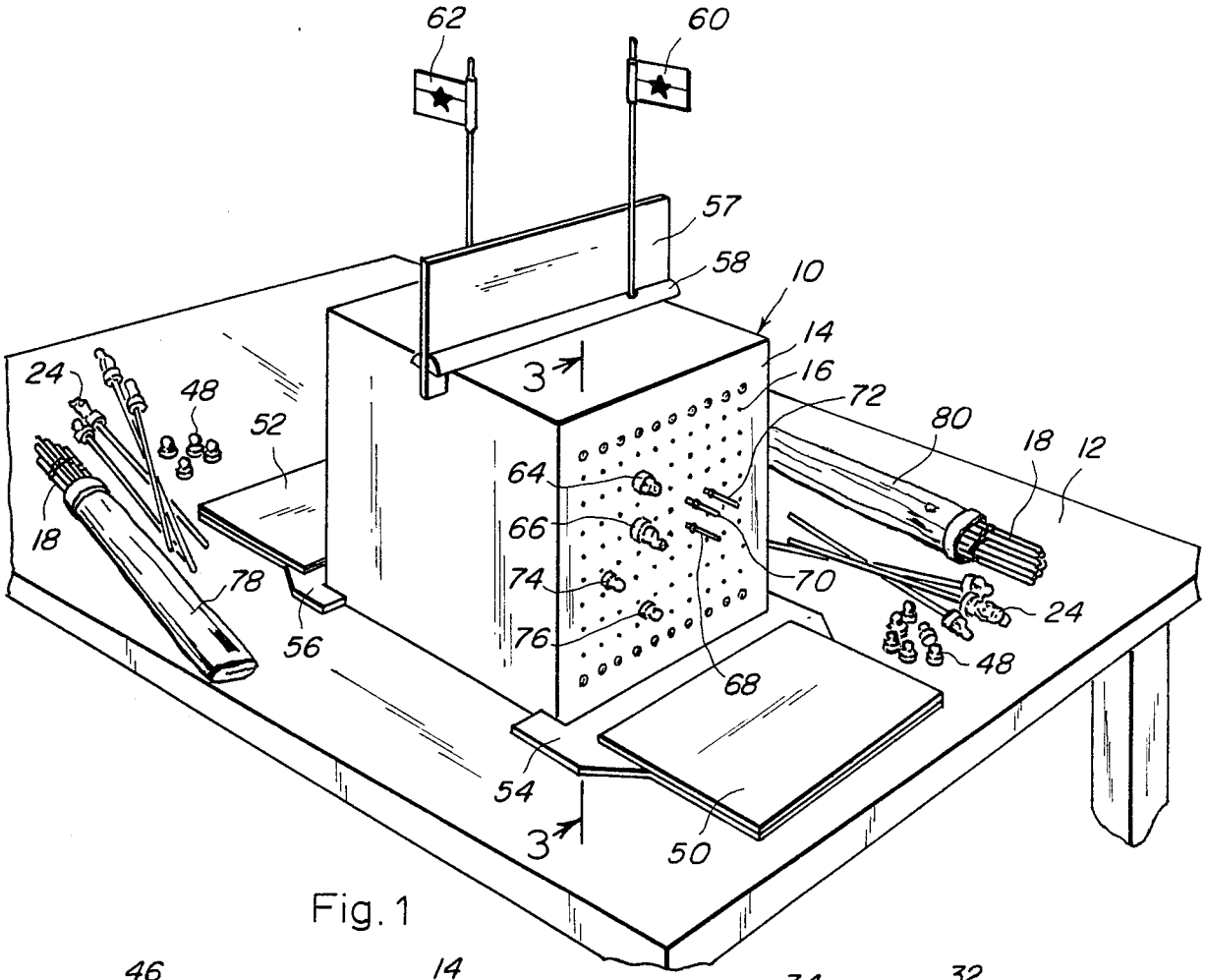
FIG. 1 is a perspective view showing the various components of the invention in use.

In FIG. 1 playing pieces 64 and 66, three simple rods 68, 70 and 72 and two markers 74 and 76 are shown. Only playing pieces are in an aperture. Bundles of simple rods may be stored in rod holders 78 and 80.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. Cube game of skill and chance, comprising in combination:

(a) a hollow cube two of whose opposite surfaces comprise identical playing surfaces comprising grids of a multiplicity of correspondingly identical apertures;

(b) flexible tubing connecting each aperture on one of said playing surfaces with the corresponding identical aperture on the opposite playing surface, said flexible tubing being of sufficient length to droop thereby preventing passage of light from one playing surface to the other while sufficiently flexing to receive a horizontal rod extending therein, thereby preventing a player adjacent one playing surface from detecting the insertion of rods in specific apertures on the other playing surface by an opposing player;

(c) rod shaped members for insertion through said apertures into said tubing, said rod shaped members formed into two groups including a first group of simple rods having a length greater than the distance between said opposite surfaces, whereby when inserted both players may view the ends of the simple rods, and a second group of playing piece rods having a length less than the distance between said opposite playing surfaces, whereby when inserted only the player inserting said playing piece rods can view the rod; and (d) marker pieces made of a ferromagnetic material, ferromagnetic material also located at least centrally between each grouping of four apertures on each of said playing surfaces on the inside playing surface of said hollow cube, whereby when said marker pieces are placed upon the outside playing surface of said hollow cube, and centrally between four of said apertures, said markers will adhere thereto due to attractive forces of magnetism.

2. A cube game of skill and chance, as recited in claim 1, wherein said tubing comprises a length of collapsible woven mesh inserted on two rivets placed in opposing apertures on said playing surfaces.

3. Cube game of skill and chance, as recited in claim 1, wherein each end of said simple rods have a marking whereby when said rod is inserted as far as the second of said markings an equal length of said simple rod will protrude from each of said playing surfaces.

4. Cube game of skill and chance, as recited in claim 1, wherein said markers are permanent magnets.

5. Cube game of skill and chance, as recited in claim 1, wherein said playing piece rods have three dimensional figures attached to one end thereof.

6. Cube game of skill and chance, as recited in claim 1, further comprising pads which surmount pad mounts whereby if one of said playing piece rods is expelled from any of said apertures said playing piece rod, which may also have a three dimensional figure attached thereupon, will fall safely upon said pad and whereby said pad mount has an open rectangular cutout which engages the end of said hollow cube thereby fixing the position of said pad mount and said pad.

7. Cube game of skill and chance, as recited in claim 1, wherein said ferromagnetic material comprises permanent magnets.

8. Cube game of skill and chance, as recited in Claim 1, further comprising a partition placeable centrally upon the top surface of said hollow cube and extending vertically and placeable in a plane parallel to said playing surfaces in order to further prevent one player from seeing movements by the other player.

* * * * *